United States Patent [19]

Barksdale

[11] 4,034,851

[45] July 12, 1977

[54] SOAP BUOY

[76] Inventor: Donald O. Barksdale, 2301 W. Lexington St., Baltimore, Md. 21223

[21] Appl. No.: 719,520

[22] Filed: Sept. 1, 1976

[51] Int. Cl.[2] ..... A47K 5/00; B63B 21/52; C11D 17/02

[52] U.S. Cl. ..... 206/77.1; 9/8 R; 23/267 A; 46/1 R; 252/134

[58] Field of Search ..... 9/8 R; 23/267 A; 46/1 R, 6; 206/77.1, 527; 210/169; 252/134, 174

[56] References Cited

U.S. PATENT DOCUMENTS

| | | | |
|---|---|---|---|
| 2,562,922 | 8/1951 | Kist | 9/8 R |
| 2,826,484 | 3/1958 | Buehler | 9/8 R |
| 2,934,409 | 4/1960 | Biehl | 23/267 A |
| 3,089,155 | 5/1963 | Bengtson | 9/8 R |
| 3,132,417 | 5/1964 | Irwin | 9/8 R X |

FOREIGN PATENT DOCUMENTS

| | | | |
|---|---|---|---|
| 1,415,787 | 9/1965 | France | 206/77.1 |
| 2,220,937 | 11/1973 | Germany | 206/77.1 |

*Primary Examiner*—Steven E. Lipman
*Attorney, Agent, or Firm*—Morton J. Rosenberg

[57] ABSTRACT

A soap buoy which is adapted to float in a body of water and be secured to a soap bar. The soap buoy includes a housing float which is bouyant in water and is connected through a cord element to a soap bar insertion member. The soap bar insertion member is inserted internal to the soap bar and allows visual observability of the location of the soap bar through observation of the housing float on the surface of the water. The housing float generally includes a transparent dome within which there is provided an elongate vertically directed element and a number of freely moveable hoop elements where the hoop elements may be displaced over the vertically directed elongate element. This combination of elements provides for a game like effect where the user may flip or otherwise try to displace the hoop elements over the vertically elongated element attached to the floor of the housing float. Still further, the housing float may include indicia of a pleasing esthetic effect to provide amusement for an operator.

10 Claims, 3 Drawing Figures

FIG. 1
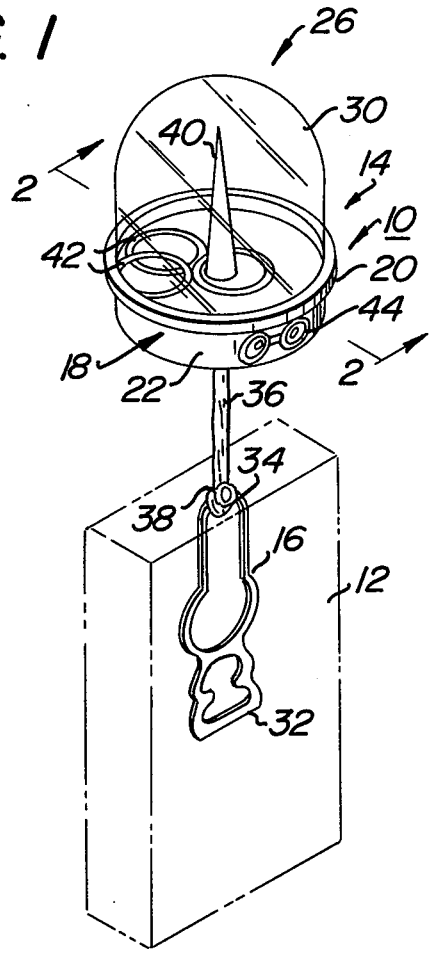
FIG. 2
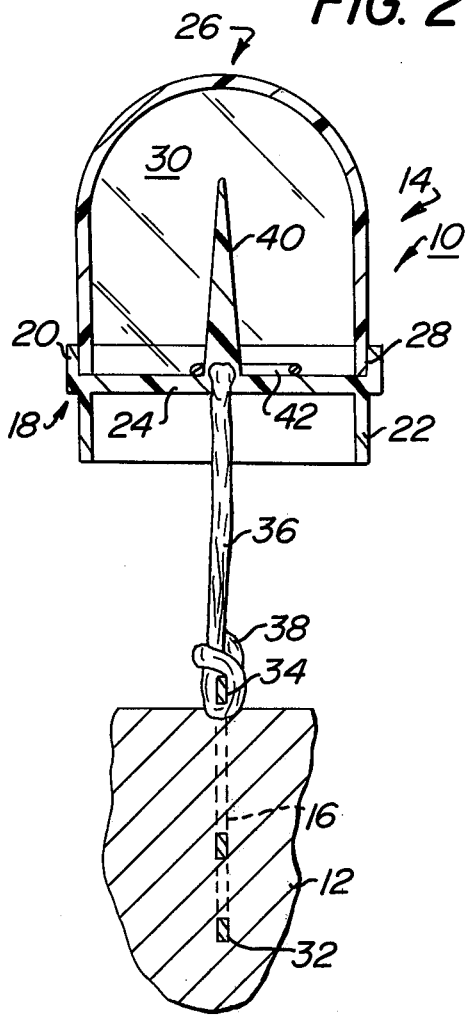
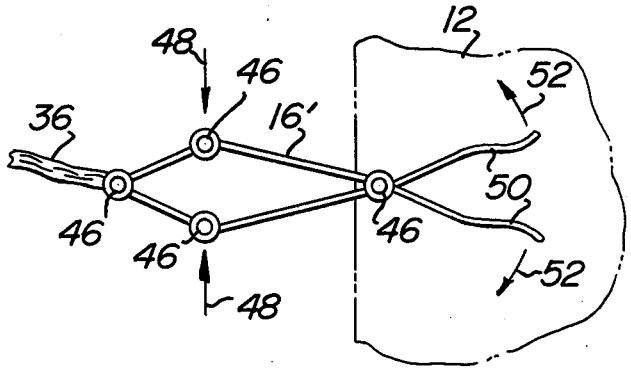
FIG. 3

SOAP BUOY

BACKGROUND OF THE INVENTION

1. Field of the Invention

This invention relates to buoy systems. In particular this invention pertains to a buoy system adapted for insertion into a bar of soap for visually marking the soap bar in a body of water. More in particular, this invention relates to a soap buoy device such that the location of the soap below the surface of a body of water can be ascertained at all times by an operator. Still further, this invention pertains to a safety device to be used in bath tubs to allow a user to visually locate a bar of soap at all times in order that the user minimizes the chances of slipping on the bar of soap. Still further, and more in particular, this invention relates to a soap buoy which may be adapted to provide amusement for an operator while taking a bath. Additionally, this invention pertains to a toy like device which is esthetically pleasing.

2. Prior Art

In general, buoys are known in the art. Additionally, bars of soap that float in bodies of water have been previously manufactured, however, buoys adapted to be inserted within a bar of soap for visual marking of the soap bar has not been found in the prior art.

Buoys for marking objects lieing below the surface of a body of water have been made of plastic material. However, in general such prior buoys are not found to be adaptable for insertion into a bar of soap for locating the soap bar below the surface of a body of water. Additionally, such buoys have not been placed in combination to provide an amusement device when a user is taking a bath.

In some prior instances, a user has been found to slip or otherwise stumble over a bar of soap which has sunk within a bath tub. In general, the bath water may becme murky or otherwise non-transparent so that a user when standing up in the bath tub may unfortunately slip on the bar of soap causing deleterious effects.

SUMMARY OF THE INVENTION

A soap buoy for visually marking a bar of soap in a body of water which includes a housing float device formed of a buoyant material for being visually observable on a surface of the body of water. The soap buoy includes a soap bar insertion mechanism which is secured to the housing float and the soap bar for locating the soap bar beneath the water surface.

BIREF DESCRIPTION OF THE DRAWINGS

FIG. 1 is a perspective drawing of the soap buoy showing insertion of the soap buoy with a bar of soap;

FIG. 2 is a sectional view of the soap buoy taken along the section lines 2—2 of FIG. 1; and, FIG. 3 is an elevation view of a portion of the soap buoy showing an embodiment of the soap insertion mechanism for positively engaging the soap bar.

DESCRIPTION OF THE PREFERRED EMBODIMENTS

Referring now to FIGS. 1 and 2 there is shown soap buoy 10 used principally for visually marking soap bar 12 in a body of water. In overall concept, buoy 10 is securely fastened to bar of soap 12 in a manner such that soap bar 12 may be utilized by an operator during the process of taking a bath and when released from the grasp of the operator will float in the bath water in order that the operator is made aware of the positional location of soap bar 12 at all times. Additionally, as will be described in following paragraphs, soap buoy 10 includes elements which may be used by the operator for amusement purposes and thus provides a game structure in combination with the buoy concept. Soap buoy 10 may further include indicia formed on an outer surface to provide a pleasing esthetic effect.

In overall concept soap buoy 10 for visually marking and locating soap bar 12 in a body of water includes housing float 14 formed of a buoyant material for being visually observable on the surface of the body of water. Additionally, soap buoy 10 includes soap bar insertion device 16 which is secured to housing float 14 and soap bar 12 for maintaining soap bar 12 in the vicinity or neighborhood of housing float 14.

Soap buoy 10 is particularly adaptable to soap bars 12 which are not buoyant in a body of water. In such cases, bars of soap 12 have a tendency to sink below the surface of the water and location of such becomes difficult especially when the water is murky or otherwise not transparent.

Housing float 14 includes base element 18 which is generally formed of a plastic material or some like composition which is buoyant in water. Base element 18 as shown in FIGS. 1 and 2 may be circular in contour and provided with upwardly extending flanges 20 to provide a cup like shape. Additionally, base element 18 includes a downwardly directed flange 22 passing around the preipheral contour of base element 18. Floor element 24 passes in a generally horizontal plane and intersects elements 20 and 22 as is shown. Base element 18 including elements 20, 22 and 24 may be formed in one-piece formation through molding or some like technique. The only restriction being that the materials of base element 18 be buoyant in water and generally impervious to water passage therethrough.

Housing float 14 further includes dome element 26 which is secured in some fixed manner to base element 18 throughout interfacing surface 28 around the peripheral boundary of base element 18. Dome 26 may be secured to flange element 20 at interfacing surface 28 through adhesive securement or some like technique well known in the art. The only restriction being that the bonding of dome element 26 to flange element 20 be impervious to water thus, it is preferred that some type of water impervious adhesive be used for the securing action.

As is seen, dome 26 in combination with floor member 24 of base element 18 provides for internal chamber 30. Additionally, dome element 26 is generally formed of a plastic material or some like composition bouyant in a body of water. Dome element 26 may be formed of a transparent plastic for providing the operator with an internal view of housing float 14 for purposes to be described in following paragraphs.

Soap bar insertion device 16 may be an elongated insert element adapted for insertion into soap bar 12 further adapted to be connected to housing float 14. Soap bar insertion device or elongated element 16 includes first end 32 used to forceably insert element 16 into soap bar 12. Generally, soap bars 12 are pliable in nature and first end elements 32 may be manually inserted internal to bar 12. Insertion device 16 includes second end 34 which may be formed in a hook shape for attachment to flexible element 36. Flexible element 36 may be a cord element which is attached to second end 34 through a loop or a knot 38 as is shown in FIGS. 1 and 2. Additionally, cord element 36 is fixedly secured to floor 24 of base element 18 by adhesive, knotting through a partial aperture in floor 24 or some like technique not important to the inventive concept as is herein detailed. Cord element 36 should be of sufficient length to permit soap bar 12 to remain in the vicinity of housing float 14 but not to be of such a length that the location of soap bar 12 would not be able to be determined by the operator. In actual practice, cord element 36 has been found to be useful when having a dimensional length in the vicinity of 2–5 inches. Cord element 36 may be made of material, natural or synthetic, or some like composition with the only restriction being that cord element 36 not readily disintegrate in a body of water.

Soap bar insertion device 16 is generally formed of a metal which may be inserted internal to soap bar 12. Additionally, a metal which does not oxidize readily in water is preferred such as stainless steel or some like material. Still further, since soap bar 12 is being used, sharp edges from elongated element 16 are generally removed in order to maintain a safety factor for the operator when utilizing soap bouy 10.

Internal to dome 26 and rising upwardly from floor 24 is extension member 40. Extension member 40 may be conical in shape and formed in one piece formation with floor member 24 through molding or some like technique. Extension member 40 is conical in contour and extends in a generally vertical direction. Additionally, hoop members 42 freely moveable within internal chamber 30 may be used in a game like fashion for being moveably displaced over extension member 40. Thus, the operator may try to flip hoop members 42 over extension member 40 for amusement purposes during use of soap bouy 10 for the main purposes as hereinbefore described. Still further, downwardly directed flange 22 may include indicia 44 which in FIG. 1 takes the form of eyes to provide a pleasing and amusing esthetic effect.

An embodiment of the invention is shown in FIG. 3 where soap bar insertion device 16′ is formed into a four bar linkage which allows for positive securement to provide fixed securing of soap bar insertion means 16′ within soap bar 12. Pivot pins 46 allow transverse displacement in a direction defined by directional arrows 48 when grasped in the hands of the operator and thus result in an opposing transverse motion of elements 50 as defined by directional arrows 52. Movement of securing elements 50 in the direction provided by directional arrows 52 generally secure insertion device 16′ in a fixed manner within soap bar 12. Thus, soap bar insertion device 16′ may take the form of a modified panthograph linkage system which is adapted to internally secure soap bar insertion device 16′ internal to soap bar 12. Additionally, in the embodiment as shown in FIG. 3, cord element 36 may be attached at one of the pivot pins 46 in a manner similar to that provided for soap bouy for soap bouy 10 as previously described.

While the invention has been described in connection with preferred specific embodiments thereof, it will be understood that this description is intended to illustrate and not limit the scope of the invention, which is defined by the appended claims.

What is claimed is:

1. A soap buoy for visually marking a bar of soap in a body of water, comprising:
   a. housing float means formed of a buoyant material for being visually observable on a surface of said body of water; and,
   b. soap bar insertion means secured to said housing float means and inserted into said soap bar for locating said soap bar beneath said water surface.

2. The soap buoy as recited in claim 1 where said soap bar insertion means is secured to said housing float means through a flexible member fastened on opposing ends thereof to said housing float means and said soap bar insertion means.

3. The soap buoy as recited in claim 2 where said flexible member is a cord element.

4. The soap buoy as recited in claim 1 where said housing float means includes:
   a. a base element; and,
   a dome element secured in fixed fashion to said base element, said dome element forming an internal chamber for said housing float means.

5. The soap buoy as recited in claim 4 where said dome element is transparent for providing an internal view of said housing float means.

6. The soap buoy as recited in claim 1 where said soap bar insertion means includes an elongated insert element inserted into said bar of soap and connected to said housing float means.

7. The soap buoy as recited in claim 1 where said soap bar insertion means includes soap bar securing means fixedly securing said soap bar insertion means within said bar of soap.

8. The soap buoy as recited in claim 1 where said soap bar insertion means includes a pantograph linkage internally securing said soap bar insertion means to said bar of soap.

9. The soap buoy as recitd in claim 8 where said pantograph linkage is fixedly secured said soap bar insertion means internal said bar of soap.

10. The soap buoy as recited in claim 1 where said housing float means is formed of a plastic material bouyant in said body of water.

* * * * *